US009449552B2

(12) United States Patent
Lee et al.

(10) Patent No.: US 9,449,552 B2
(45) Date of Patent: Sep. 20, 2016

(54) ORGANIC LIGHT EMITTING DISPLAY DEVICE AND DRIVING METHOD THEREOF INCLUDING RESPONSE TO PANEL ABNORMALITY

(71) Applicant: LG Display Co., Ltd., Seoul (KR)
(72) Inventors: Ji Eun Lee, Seoul (KR); Joong Sun Yoon, Gyeonggi-do (KR); Seon Mi Lee, Gyeonggi-do (KR); Boeon Byeon, Gwangju (KR)
(73) Assignee: LG Display Co., Ltd., Seoul (KR)

( * ) Notice: Subject to any disclaimer, the term of this patent is extended or adjusted under 35 U.S.C. 154(b) by 198 days.
(21) Appl. No.: 14/108,357
(22) Filed: Dec. 17, 2013
(65) Prior Publication Data
US 2014/0176524 A1 Jun. 26, 2014
(30) Foreign Application Priority Data
Dec. 26, 2012 (KR) ..... 10-2012-0153636
Dec. 2, 2013 (KR) ..... 10-2013-0148802
(51) Int. Cl.
*G09G 3/32* (2016.01)
(52) U.S. Cl.
CPC ..... *G09G 3/3233* (2013.01); *G09G 2330/02* (2013.01); *G09G 2330/04* (2013.01); *G09G 2330/10* (2013.01); *G09G 2330/12* (2013.01)
(58) Field of Classification Search
CPC .... G09G 3/006; G09G 3/3233; G09G 3/325; G09G 3/3266; G09G 3/30; G09G 3/3225; G09G 2330/02; G09G 2330/028; G09G 2330/04; G09G 2330/045; G09G 2330/10; G09G 2330/12
See application file for complete search history.

(56) References Cited

U.S. PATENT DOCUMENTS

2005/0116657 A1* 6/2005 Park ..... G09G 3/22 315/169.3
2006/0050027 A1* 3/2006 Meguro ..... G09G 3/006 345/75.2
2007/0080905 A1* 4/2007 Takahara ..... G09G 3/3233 345/76
2008/0143655 A1* 6/2008 Ko ..... G09G 3/3291 345/82
2008/0246698 A1* 10/2008 Eom ..... G09G 3/3266 345/76
2010/0103160 A1* 4/2010 Jeon ..... G09G 3/3233 345/213
2010/0220088 A1* 9/2010 Kim ..... G09G 3/3208 345/211
2011/0074664 A1* 3/2011 Lebrun ..... G09G 3/006 345/98
2012/0256897 A1* 10/2012 Seo ..... G09G 3/006 345/212
2013/0002736 A1* 1/2013 Park ..... G09G 3/3225 345/691
2013/0113775 A1* 5/2013 Seo ..... G09G 3/3208 345/211
2013/0155033 A1* 6/2013 Jin ..... G09G 3/3266 345/204
2013/0201171 A1* 8/2013 Song ..... G09G 3/20 345/212
2015/0009198 A1* 1/2015 Park ..... G09G 3/3233 345/212

* cited by examiner

*Primary Examiner* — Keith Crawley
(74) *Attorney, Agent, or Firm* — Morgan, Lewis & Bockius LLP

(57) ABSTRACT

Disclosed is an organic light emitting display device. The organic light emitting display device includes a panel in which a plurality of pixels are respectively formed in intersection areas between a plurality of gate lines and a plurality of data lines formed in an active area, a pixel circuit is included in each of the pixels, and a plurality of power lines are formed for supplying power to drive the pixel circuit; a gate driving IC configured to supply a scan signal to the gate lines, a power supply configured to supply the power to the power lines, a detection unit configured to detect a panel abnormality in the active area by using a sensing signal collected through a sensing line electrically connected to a corresponding gate line, and a controller configured to control driving of the power supply according to the detection result of the detection unit.

17 Claims, 9 Drawing Sheets

(a)

(b)

(c)

ORGANIC LIGHT EMITTING DISPLAY DEVICE AND DRIVING METHOD THEREOF INCLUDING RESPONSE TO PANEL ABNORMALITY

CROSS-REFERENCE TO RELATED APPLICATIONS

This application claims the benefit of the Korean Patent Application No. 10-2012-0153636 filed on Dec. 26, 2012 and 10-2013-0148802 filed on Dec. 2, 2012, which are hereby incorporated by reference as if fully set forth herein.

BACKGROUND

1. Field of the Invention

The present invention relates to an organic light emitting display device, and more particularly, to an organic light emitting display device and a driving method thereof, which can prevent a panel abnormality, such as short circuit, burning, or a line defect, of an organic light emitting panel from being spread.

2. Discussion of the Related Art

Flat panel display (FPD) devices are applied to various electronic devices such as portable phones, tablet personal computers (PCs), notebook computers, etc. The FPD devices include liquid crystal display (LCD) devices, plasma display panel (PDP) devices, light-emitting display devices, etc. Recently, electrophoretic display (EPD) devices are widely used as the FPD devices.

In such FPD devices, the light emitting display devices have a fast response time of 1 ms or less and low power consumption, and have no limitation in a viewing angle because the light emitting display devices self-emit light. Accordingly, the light emitting display devices are attracting much attention as next generation FPD devices.

Generally, the light emitting display devices are display devices that electrically excite a light emitting material to emit light, and are categorized into inorganic light emitting display devices and organic light emitting display devices depending on a material and a structure thereof.

FIG. 1 is a circuit diagram schematically illustrating a pixel circuit of a general organic light emitting display device.

A plurality of pixels, which are respectively formed in a plurality of areas defined by intersections between a plurality of gate lines and a plurality of data lines, are formed in a panel of the organic light emitting display device. A pixel circuit is formed in each of the plurality of pixels.

The pixel circuit, as illustrated in FIG. 1, includes a switching transistor ST, a driving transistor DT, a capacitor C, and a light emitting element OLED.

The switching transistor ST is turned on by a scan signal supplied to a gate line GL, and supplies a data voltage Vdata, supplied from a data line DL, to the driving transistor DT.

The driving transistor DT is turned on with the data voltage Vdata supplied from the switching transistor ST, and controls a data current Ioled which flows from a high-level driving voltage ELVDD terminal to the light emitting element OLED.

The capacitor C is connected to a gate of the driving transistor DT, stores a voltage corresponding to the data voltage Vdata supplied to the gate of the driving transistor DT, and turns on the driving transistor DT with the stored voltage.

The light emitting element OLED is electrically connected between the driving transistor DT and a low-level driving voltage ELVSS terminal (a ground terminal), and emits light with the data current Ioled supplied from the driving transistor DT. Here, the data current Ioled flowing in the light emitting element OLED is determined according to a gate-source voltage of the driving transistor DT, a threshold voltage of the driving transistor DT, and the data voltage Vdata.

The pixel circuit of the general organic light emitting display device controls a level of the data current Ioled, which flows from the high-level driving voltage ELVDD terminal to the light emitting element OLED, according to the data voltage Vdata supplied to the gate of the driving transistor DT to emit light from the light emitting element OLED, thereby displaying an image.

FIG. 2 is an exemplary diagram illustrating a configuration of a general organic light emitting display device.

The general organic light emitting display device, as illustrated in FIG. 2, includes: a panel 10 in which a plurality of pixels are respectively formed in a plurality of areas defined by intersections between a plurality of gate lines GL1 to GLn and a plurality of data lines DL1 to DLm; a gate driving integrated circuit (IC) 20 that supplies a scan signal to the plurality of gate lines; a source driving IC 30 that respectively supplies data voltages to the plurality of data lines; a timing controller 40 that controls driving of the gate driving IC 20 and driving of the source driving IC 30; and a power supply 50 that supplies a high-level driving voltage ELVDD and a low-level driving voltage ELVSS to the plurality of pixels.

In the general organic light emitting display device, as illustrated in FIG. 2, a high-level driving voltage ELVDD line 51 and a low-level driving voltage ELVSS line 52 are disposed in an upper inactive area and a lower inactive area, and the data lines DL1 to DLm extend from the source driving IC 30 to overlap the high-level driving voltage ELVDD line 51 and the low-level driving voltage ELVSS line 52.

In addition to the high-level driving voltage ELVDD line 51 and the low-level driving voltage ELVSS line 52, various power lines such as a reference voltage Vref line are formed to overlap the data lines.

An organic layer covering the lines is damaged by various causes, or when short circuit between the lines occurs, defects such as burning and a line defect can occur.

In order to prevent defects such as short circuit, burning, and a line defect, in the related art, short circuit or burning is detected through a guide ring that is formed outside an active area 12, namely, in the inactive area.

However, in the related art, short circuit, burning, or a line defect is detected in only the inactive area, and thus, even when a failure is caused by short circuit, burning, or a line defect which occurs in the active area 12, it is unable to appropriately respond to the failure.

The above-described overlapping section is formed in the active area 12 as well as the inactive area, and particularly, power lines such as the high-level driving voltage ELVDD line 51, the low-level driving voltage ELVSS line 52, the reference voltage Vref line (not shown), and the data line DL overlap the gate lines GL in various types in the active area 12.

Therefore, when the organic layer insulating the lines is damaged by a crack or the like, there is a high possibility that short circuit occurs between the lines. When the short circuit occurs, a current flows through the lines, and thus, there is a high possibility that burning occurs in the gate driving IC 20 or the panel 10.

However, as described above, in the related art, since a sensing line for detecting short circuit, burning, or a line defect in the active area 12 is not provided, it is unable to appropriately respond to the short circuit, the burning, or the line defect in the active area 12.

Moreover, a method in which an additional detection line is formed in the active area 12 is proposed for detecting the short circuit, burning, or line defect of the overlapping section in the active area 12. However, in organic light emitting display devices using the method, an aperture ratio of the active area is reduced, and the overlapping section increases, causing the other problems.

SUMMARY

Accordingly, the present invention is directed to provide an organic light emitting display device and a driving method thereof that substantially obviate one or more problems due to limitations and disadvantages of the related art.

An aspect of the present invention is directed to provide an organic light emitting display device and a driving method thereof, which detect a panel abnormality in an active area by using a plurality of sensing signals which are respectively collected through a plurality of gate lines overlapping a plurality of power lines in the active area.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device including: a panel in which a plurality of pixels are respectively formed in a plurality of intersection areas between a plurality of gate lines and a plurality of data lines formed in an active area, a pixel circuit is included in each of the plurality of pixels, and a plurality of power lines are formed for supplying power necessary to drive the pixel circuit; a gate driving integrated circuit (IC) configured to supply a scan signal to the plurality of gate lines; a power supply configured to supply the power to the power lines; a detection unit configured to detect a panel abnormality in the active area by using a sensing signal collected through a sensing line electrically connected to a corresponding gate line; and a controller configured to control driving of the power supply according to the detection result of the detection unit.

In another aspect of the present invention, there is provided a method of driving an organic light emitting display device including: supplying power to a plurality of power lines, which are formed in an active area of a panel in which a plurality of gate lines and a plurality of data lines formed, to drive a plurality of pixel circuits included in the panel; detecting a panel abnormality in the active area by using a sensing signal collected through a sensing line electrically connected to a corresponding gate line; and when the panel abnormality is detected, cutting off the power supplied to the plurality of power lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
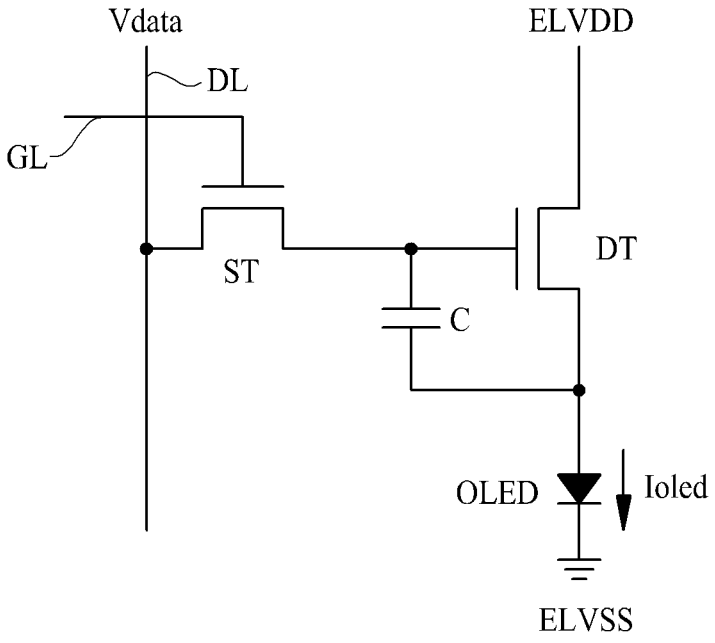
FIG. 1 Related Art
FIG. 1 is a circuit diagram schematically illustrating a pixel circuit of a general organic light emitting display device.
Figure 2:
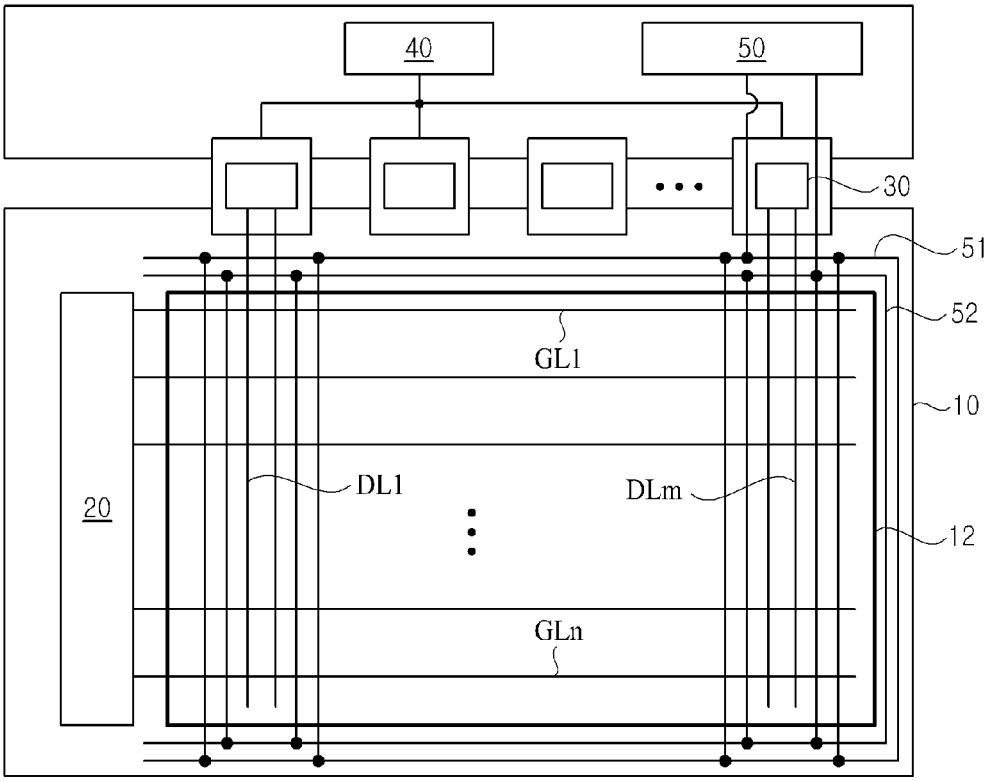
FIG. 2 Related Art
FIG. 2 is an exemplary diagram illustrating a configuration of a general organic light emitting display device.
Figure 3:
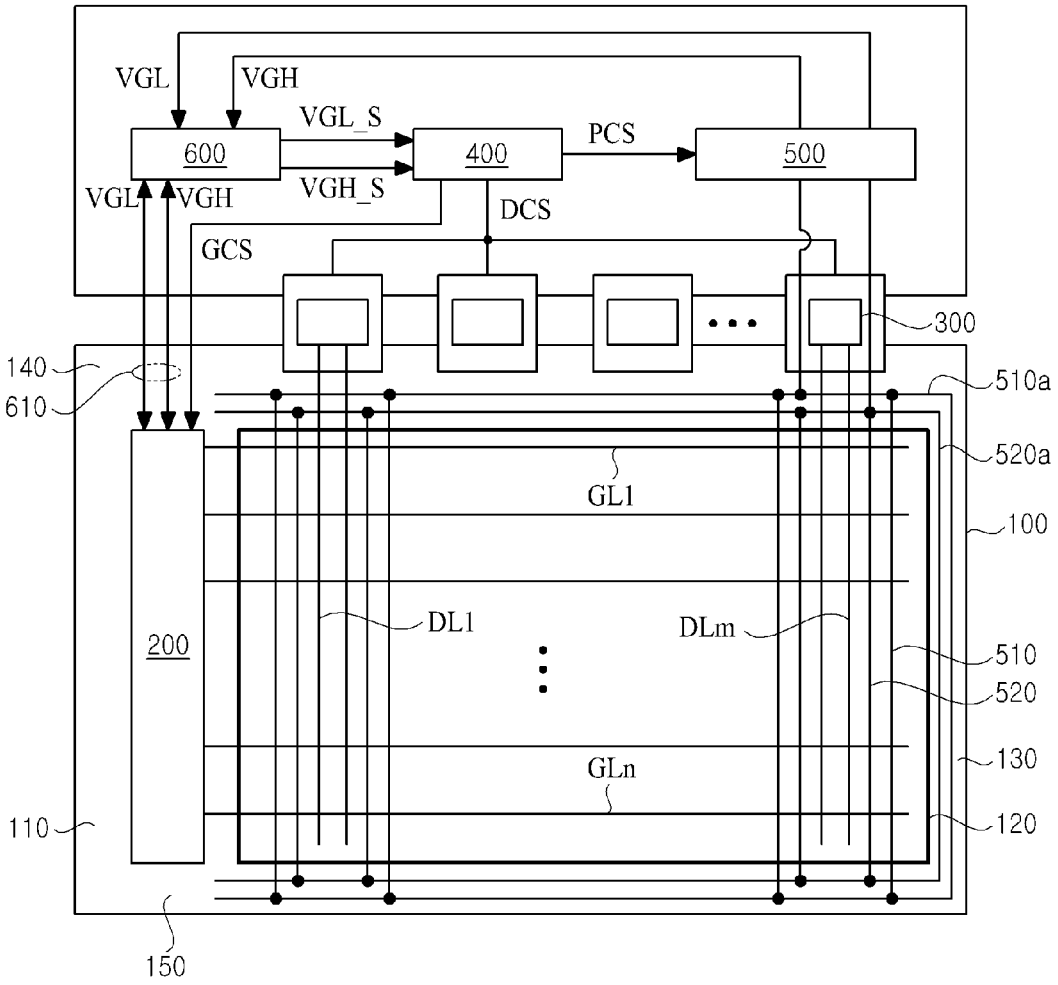
FIG. 3 is an exemplary diagram schematically illustrating an organic light emitting display device according to the present invention.
Figure 4:
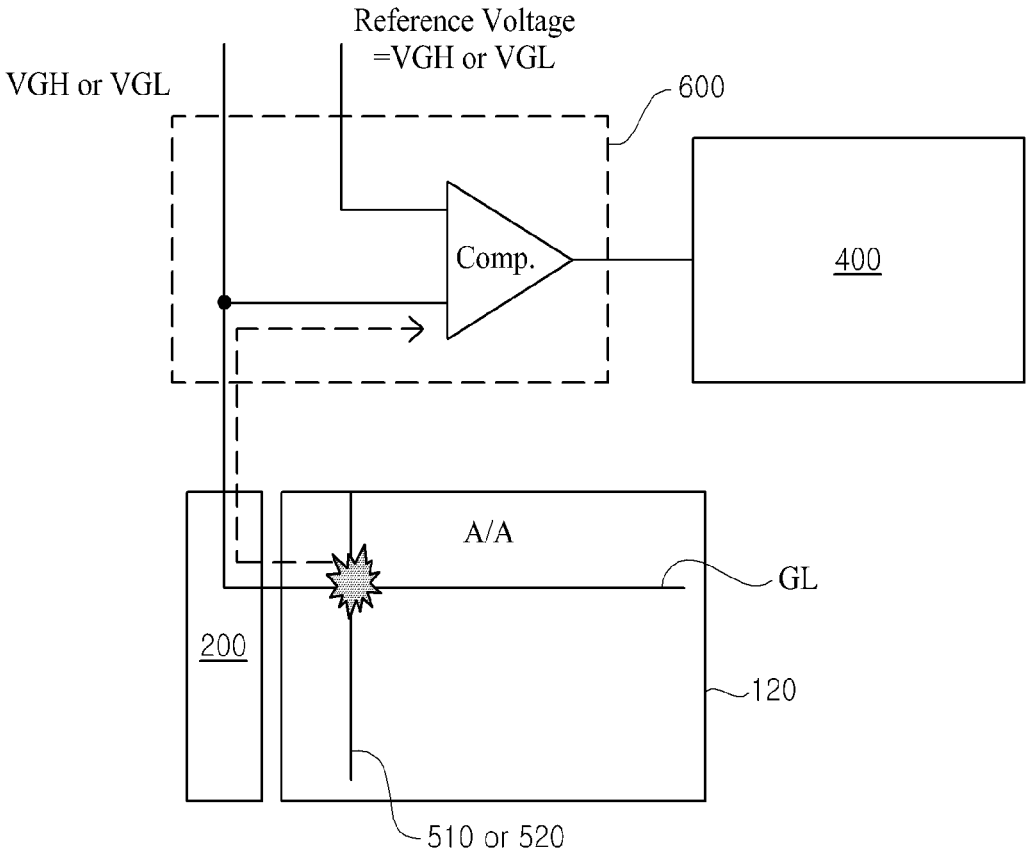
FIG. 4 is an exemplary diagram schematically illustrating a configuration of a detection unit applied to the organic light emitting display device according to the present invention.

FIG. 3 is an exemplary diagram schematically illustrating an organic light emitting display device according to the present invention, and FIG. 4 is an exemplary diagram schematically illustrating a configuration of a detection unit applied to the organic light emitting display device according to the present invention.

A high-level driving voltage line, a low-level driving voltage line, a reference voltage line, an input voltage line, a data line, and a gate line, which are formed in a panel so as to drive an organic light emitting display device, overlap each other in an active area of the panel. Therefore, an insulating layer insulating the lines is damaged by a crack or the like, and when short circuit between the lines occurs, a burning defect is caused by the partial concentration of a current.

A generic name for short circuit, burning, and a line defect is simply referred to as a panel abnormality. That is, in the following description, the panel abnormality denotes the short circuit, the burning, and the line defect, and when the panel abnormality occurs, an abnormal current or an overcurrent flows through the lines. The burning denotes slight fire occurring in the panel. The line defect denotes a case, in which the insulating layer between the lines is damaged, or a case in which a problem occurs in circuit because the lines are abnormally adjacent to each other. The abnormal current is a current that abnormally flows through the lines, instead of the overcurrent, and denotes a current, of which flow is not constant, or which should not flow through the lines. Hereinabove, it has been described that the abnormal current or the overcurrent is caused by the panel abnormality, but a case itself in which the abnormal current or the overcurrent occurs may be included in the panel abnormality. That is, since the abnormal current or the overcurrent occurs due to various causes in addition to the short, the burning, or the line defect, and causes a problem to the panel, the abnormal current or the overcurrent may also be included in the panel abnormality.

In order to respond to the panel abnormality, proposed was a related art method that detects the panel abnormality through a guide ring formed in an inactive area.

However, the related art method detects the panel abnormality in only the inactive area, and cannot detect the panel abnormality in the active area.

Therefore, the present invention is for the purpose of detecting the panel abnormality in the active area by using a detection signal that is detected through a plurality of gate lines overlapping a plurality of power lines in the active area.

To this end, as illustrated in FIG. 3, the organic light emitting display device according to the present invention includes: a panel 100 that includes a plurality of pixels, which are respectively formed in a plurality of intersection areas between a plurality of gate lines GL1 to GLn and a plurality of data lines DL1 to DLm, and a plurality of power lines 510 and 520 that are formed to intersect the gate lines GL1 to GLn in an active area 120 so as to supply desired power to a pixel circuit of each of the plurality of pixels; a gate driving integrated circuit (IC) 200 that supplies a scan signal to the plurality of gate lines; a source driving IC 300 that respectively supplies data voltages to the plurality of data lines; a power supply 500 that supplies the power to the power lines 510 and 520; a detection unit 600 that detects the panel abnormality in the active area 120 by using a sensing signal collected through a sensing line electrically connected to a corresponding gate line; and a timing controller 400 that controls driving of the power supply 500 according to the detection result of the detection unit 600.

First, the plurality of pixels are respectively formed in the plurality of intersection areas between the plurality of gate lines GL1 to GLn and the plurality of data lines DL1 to DLm, and the pixel circuit is provided in each of the plurality of pixels.

The pixel circuit includes a switching transistor, a driving transistor, a capacitor, and an organic light emitting element.

The switching transistor is turned on according to the scan signal supplied through a corresponding gate line, and supplies a data voltage, supplied through a corresponding data line, to the driving transistor.

The driving transistor is turned on with the data voltage supplied from the switching transistor, and controls a current flowing from a high-level driving voltage terminal to the organic light emitting element.

The pixel circuit may include a plurality of transistors in addition to the driving transistor and the switching transistor.

For example, the organic light emitting element is easily deteriorated, and thus, when the organic light emitting display device is used for a long time, a quality of the organic light emitting display device can be degraded. To solve such a problem, the pixel circuit may include a plurality of characteristic sensing transistors for sensing a characteristic of the organic light emitting element, and may include a plurality of compensation transistors for compensating for a deterioration of the organic light emitting element. In this case, the characteristic sensing transistors and the compensation transistors may be driven with an input voltage Vinit and a reference voltage Vref. Therefore, the pixel circuit may be supplied with the input voltage Vinit and reference voltage Vref having various levels, in addition to a high-level driving voltage and a low-level driving voltage.

The reference voltage Vref and the input voltage Vinit, as described above, are voltages that are supplied to the pixel circuit so as to compensate for driving and compensation of the organic light emitting element OLED, and have various levels depending on a configuration of the pixel circuit. Also, a transistor receiving the reference voltage or the input voltage is connected to the pixel circuit in various structures, and is generally used in a pixel circuit of a general organic light emitting display device.

Therefore, the reference voltage, the input voltage, and the transistors receiving the voltages will be described in detail below.

The capacitor is connected to a gate of the driving transistor, stores a voltage corresponding to the data voltage supplied to the gate of the driving transistor, and turns on the driving transistor with the stored voltage.

The light emitting element is electrically connected between the driving transistor and a low-level driving voltage terminal, and emits light with a current supplied from the driving transistor. Here, the current flowing in the light emitting element is determined according to a gate-source voltage of the driving transistor, a threshold voltage of the driving transistor, and the data voltage.

The pixel circuit controls a level of the current, which flows from the high-level driving voltage terminal to the light emitting element, according to the data voltage supplied to the gate of the driving transistor to emit light from the light emitting element, thereby displaying an image.

In the panel 100, a plurality of power lines, such as a high-level voltage line for supplying the high-level voltage to the organic light emitting element, a low-level voltage line for supplying the low-level voltage to the organic light emitting element, a reference voltage line 510 for supplying the reference voltage Vref to the pixel circuit, and an input voltage line 520 for supplying the input voltage Vinit to the pixel circuit, are formed to intersect the gate lines in the active area 120 displaying an image.

The voltages should be supplied to all the pixels formed in the active area 120, and thus, the power lines for transferring the voltages are formed to intersect the gate lines in the active area 120.

The data lines are also formed to intersect the gate lines in the active area 120.

A third inactive area 140 and a fourth inactive area 150, in which the source driving IC 300 is connected to the panel 100 and which are respectively formed at an upper portion and a lower portion of the panel 100. A plurality of power connection lines 510*a* and 520*a* connected to the power supply 500, as illustrated in FIG. 3, are formed in a width direction of the panel 100 in the third inactive area 140 and the fourth inactive area 150.

Therefore, the power connection lines formed in the third inactive area 140 are formed to intersect the data lines extending from the source driving IC 300.

The gate driving IC 200, as illustrated in FIG. 3, is provided in the inactive area 110 of the panel 100.

A sensing line 610, which is connected to at least one of the gate lines through the gate driving IC 200, is formed in the inactive area. The detection unit 600 is electrically connected to the gate line through the sensing line 610. A sensing signal may be transferred to the detection unit 600 through the sensing line 610 and the gate driving IC 200. In this case, as illustrated in FIG. 3, a gate high voltage VGH and a gate low voltage VGL necessary to drive the gate driving IC 200 may be supplied to the gate driving IC 200 through the sensing line 610. However, the present invention is not limited thereto. That is, the sensing line 610 may perform only a function that transfers the sensing signal, transferred through the gate driving IC 200, to the detection unit 600.

Therefore, in FIG. 3 illustrating the sensing line 610 that performs a function of transferring the gate high voltage VGH and the gate low voltage VGL to the gate driving IC 200 and a function of transferring the sensing signal transferred through the gate driving IC 200 to the detection unit 600, two sensing lines 610 are formed in the inactive area 110, but are not limited thereto. For example, the sensing line 610 may be formed as only one, or may be formed as three or more. That is, the sensing line 610 may be formed as the number of gate lines, and may be formed in correspondence with a plurality of gate lines that are separated from each other at certain intervals among the gate lines.

Moreover, when the gate driving IC 200 is provided in each of two inactive areas 110 and 130 facing each other among the inactive areas, the sensing line 610 may be formed in each of the two inactive areas 110 and 130. In this case, a plurality of sensing lines 610 formed in the first inactive area 110 may be connected to odd-numbered gate lines, and a plurality of sensing lines 610 formed in the second inactive area 120 facing the first inactive area 110 may be connected to even-numbered gate lines.

In FIG. 3, it is illustrated that the power connection lines 510*a* and 520*a* do not intersect the sensing line 610 in the third and fourth inactive areas 140 and 150.

When arrangement of the power connection lines 510*a* and 520*a* or arrangement of the sensing line 610 is changed, the power connection lines 510*a* and 520*a* may intersect the sensing line 610.

As described above, the sensing line 610 is connected to the gate line through the gate driving IC 200, and at least one or more sensing lines 610 may be formed in the inactive area of the panel 100. The sensing line 610 may be formed to intersect the power connection lines 510*a* and 520*a* in the inactive area of the panel 100.

The gate driving IC 200 sequentially supplies a gate-on signal to the gate lines by using gate control signals GCS generated by the timing controller 400.

Here, the gate-on signal denotes a voltage that turns on a switching thin film transistor (TFT) connected to a corresponding gate line. A voltage for turning off the switching TFT is a gate-off signal, and a generic name for the gate-on signal and the gate-off signal is referred to as a scan signal.

When the switching TFT is an N-type TFT, the gate-on signal is a high-level voltage, and the gate-off signal is a low-level voltage. When the switching TFT is a P-type TFT, the gate-on signal is a low-level voltage, and the gate-off signal is a high-level voltage. The high-level voltage is a voltage corresponding to the gate high voltage VGH, and the low-level voltage is a voltage corresponding to the gate low voltage VGL.

The gate driving IC 200 may be provided independent from the panel 100, and may be connected to the panel 100 through a tape carrier package (TCP) or a flexible printed circuit board (FPCB). However, as illustrated in FIG. 3, the gate driving IC 200 may be provided as a gate-in panel (GIP) type which is mounted on the panel 100.

As described above, the gate driving IC 200 may be provided in each of the first and second inactive areas 110 and 130 facing each other in the panel 100.

In this case, as illustrated in FIG. 3, the gate driving IC 200 provided in the first inactive area 110 may be connected to the detection unit 600. Also, the gate driving IC 200 (not shown) provided in the second inactive area 130 may be connected to the detection unit 600 (not shown).

That is, in the organic light emitting display device according to the present invention, each of the gate driving IC 200 and the detection unit 600 may be provided as two.

However, when the gate driving IC 200 is provided as two, only one detection unit 600 may be provided.

The source driving IC 300 converts digital image data, transferred from the timing controller 400, into data voltages, and respectively supplies the data voltages for one horizontal line to the data lines at every one horizontal period in which the scan signal is supplied to one gate line.

The source driving IC 300, as illustrated in FIG. 3, may be connected to the panel 100 in a chip-on film (COF) type, or may be directly mounted on the panel 100. The number of source driving ICs 300 may be variously set according to a size, a resolution, etc. of the panel 100.

The source driving IC 300 converts the image data into the data voltages by using gamma voltages supplied from a gamma voltage generator (not shown), and respectively outputs the data voltages to the data lines. To this end, the source driving IC 300 includes a shift register, a latch, a digital-to-analog converter (DAC), and an output buffer.

The shift register outputs a sampling signal by using data control signals (SSC, SSP, etc.) received from the timing controller 400.

The latch latches the digital image data sequentially received from the timing controller 400, and then simultaneously outputs the latched image data to the DAC.

The DAC simultaneously converts the image data, transferred from the latch, into positive or negative data voltages, and outputs the positive or negative data voltages. That is, the DAC converts the image data into the positive or negative data voltages by using the gamma voltages supplied from the gamma voltage generator (not shown), and respectively outputs the positive or negative data voltages to the data lines.

The output buffer respectively outputs the positive or negative data voltages, transferred from the DAC, to the data lines DL of the panel 100 according to a source output enable signal SOE transferred from the timing controller 400.

The power supply 500 supplies power to the power lines.

As described above, the high-level voltage and the low-level voltage are supplied to the organic light emitting element through the high-level voltage line and the low-level voltage line which are respectively connected to an anode and a cathode of the organic light emitting element. The reference voltage Vref is supplied to the pixel circuit included in each pixel through the reference voltage line 510, and the input voltage Vinit is supplied to the pixel circuit through the input voltage line 520.

The power supply 500 generates the voltage, and supplies the voltage to the pixel circuit through a corresponding power line.

The power connection lines 510*a* and 520*a* respectively connecting the power supply 500 to the power lines 510 and 520 may be formed to intersect the data lines DL1 to DLm in the third and fourth inactive areas 140 and 150, respectively.

The detection unit 600 detects the panel abnormality in the active area by using the sensing signal collected through the gate line.

For example, the detection unit 600 may detect the panel abnormality in the active area by using the gate high voltage VGH or gate low voltage VGL of the scan signal or a current that is generated from the gate high voltage VGH or the gate low voltage VGL.

As described above, the scan signal is composed of the gate high voltage VGH or the gate low voltage VGL, and the panel abnormality occurs in the active area 120. Therefore, the detection unit 600 may detect a change in an amount of voltage or current, which is collected through the gate driving IC 200 from the panel 100 receiving the scan signal to determine whether the panel abnormality occurs in the active area 120.

To this end, as illustrated in FIG. 4, the detection unit 600 compares a reference signal and a current that is generated from all or one of the gate high voltage VGH and the gate low voltage VGL which are transferred through the gate driving IC 200 from the sensing line 610 connected to the gate line, thereby generating a detection signal VGL_S or VGH_S. The detection unit 600 transfers the detection signal VGL_S or VGH_S to the timing controller 400.

However, the detection unit 600 is not limited to the configuration of FIG. 4. For example, the detection unit 600 may be provided in various structures for detecting the panel abnormality in the active area by using various sensing signals transferred through the gate lines and the gate driving IC 200. A detailed example of the detection unit 600 will be described in detail with reference to FIGS. 5 to 8.

The detection unit 600, as described above, may be connected to at least one or more of the gate lines, which are formed in the panel 100, through the gate driving IC 200.

In this case, the circuit of FIG. 4 may be separately provided for each sensing line 610 connected to a corresponding gate line.

When the detection unit 600 is connected to the gate line through the sensing line 610 in the inactive area and the sensing line 610 is formed to intersect the power connection lines 510*a*and 520*a* in the inactive area, the detection unit 600 may detect the panel abnormality in the inactive area through the sensing line 610.

The timing controller 400 generates a gate control signal GCS used to control an operation timing of the gate driving IC 200 and a data control signal DCS used to control an operation timing of the source driving IC 300 by using a timing signal (i.e., a vertical sync signal Vsync, a horizontal sync signal Hsync, and a data enable signal DE) input from an external system (not shown), and converts, video data input from the external system, into image data to be transferred to the source driving IC 300.

To this end, the timing controller 400 includes: a receiver that receives input video data and timing signals from the external system; a control signal generator that generates various control signals; a data aligner that realigns the input video data to output realigned image data; and an output unit that outputs the control signals and the image data.

That is, the timing controller 400 realigns the input video data input from the external system so as to match a structure and a characteristic of the panel 100, and transfers the realigned image data to the source driving IC 300. Such a function may be performed by the data aligner.

The timing controller 400 generates the data control signal DCS used to control the source driving IC 300 and the gate control signal GCS used to control the gate driving IC 200 by using the timing signals (i.e., the vertical sync signal Vsync, the horizontal sync signal Hsync, and the data enable signal DE, etc.) transferred from the external system, and respectively transfers the control signals to the source driving IC 300 and the gate driving IC 200. Such a function may be performed by the control signal generator.

A plurality of the data control signals DCS generated by the control signal generator may include a source start pulse SSP, a source shift clock signal SSC, a source output enable signal SOE, and a polarity control signal POL.

A plurality of the gate control signals GCS generated by the control signal generator may include a gate start pulse GSP, a gate start signal VST, a gate shift clock GCS, a gate output enable signal GOE, and a gate clock GCLK.

Moreover, the timing controller 400 controls driving of the power supply 500 according to the detection result of the detection unit 600.

When it is determined that the panel abnormality occurs in the active area 120 as an analysis result of the detection signal VGL_S or VGH_S transferred from the detection unit 600, the timing controller 400 turns off the power supply 500, thereby preventing worse panel abnormality from occurring in the active area 120. To this end, the timing controller 400 may transfer a power control signal PCS to the power supply 500.

Moreover, when it is determined that the panel abnormality occurs in the active area 120, the timing controller 400 may control driving of the gate driving IC 200 or source driving IC 300 in addition to the power supply 500, thereby preventing worse panel abnormality from occurring in the active area 120. To this end, the timing controller 400 may generate various control signals, and transfer the various control signals to the gate driving IC 200 or the source driving IC 300.

The present invention detects the panel abnormality occurring in the organic light emitting display device, and responds to the panel abnormality. In detail, the present invention detects the panel abnormality in the active area 120 of the panel 100 by using a current or a voltage of the gate-on signal or gate-off signal which is output to the gate line. Also, when it is determined that the panel abnormality occurs, the present invention controls driving of the power supply 500, source driving IC 300, and gate driving IC 200, and thus can prevent the panel abnormality in the active area 120 from being spread, or prevent the power supply 500, the source driving IC 300, and the gate driving IC 200 from being damaged.

That is, the present invention senses a change in a voltage or a current, which is supplied to the gate line formed in the active area 120, to detect the panel abnormality in the active area 120, and when the panel abnormality occurs, the present invention responds to the panel abnormality, thereby preventing the panel abnormality in the active area 120 from being spread.

Hereinabove, it has been described that when the panel abnormality occurs, the timing controller 400 controls driving of the power supply 500, source driving IC 300, and gate driving IC 200. However, the control may be performed by an element other than the timing controller 400. For example, the control function may be performed by a driver IC into which the timing controller 400 and the source driving IC 300 are integrated as one body, and instead of the timing controller 400, a separate element may control driving of the power supply 500, source driving IC 300, and gate driving IC 200.

Therefore, when the panel abnormality occurs, an element that controls driving of the power supply 500, source driving IC 300, and gate driving IC 200 is simply referred to as a control unit. However, for convenience of description, a case in which the timing controller performs a function of the control unit will be described as an example of the present invention.

Figure 5:
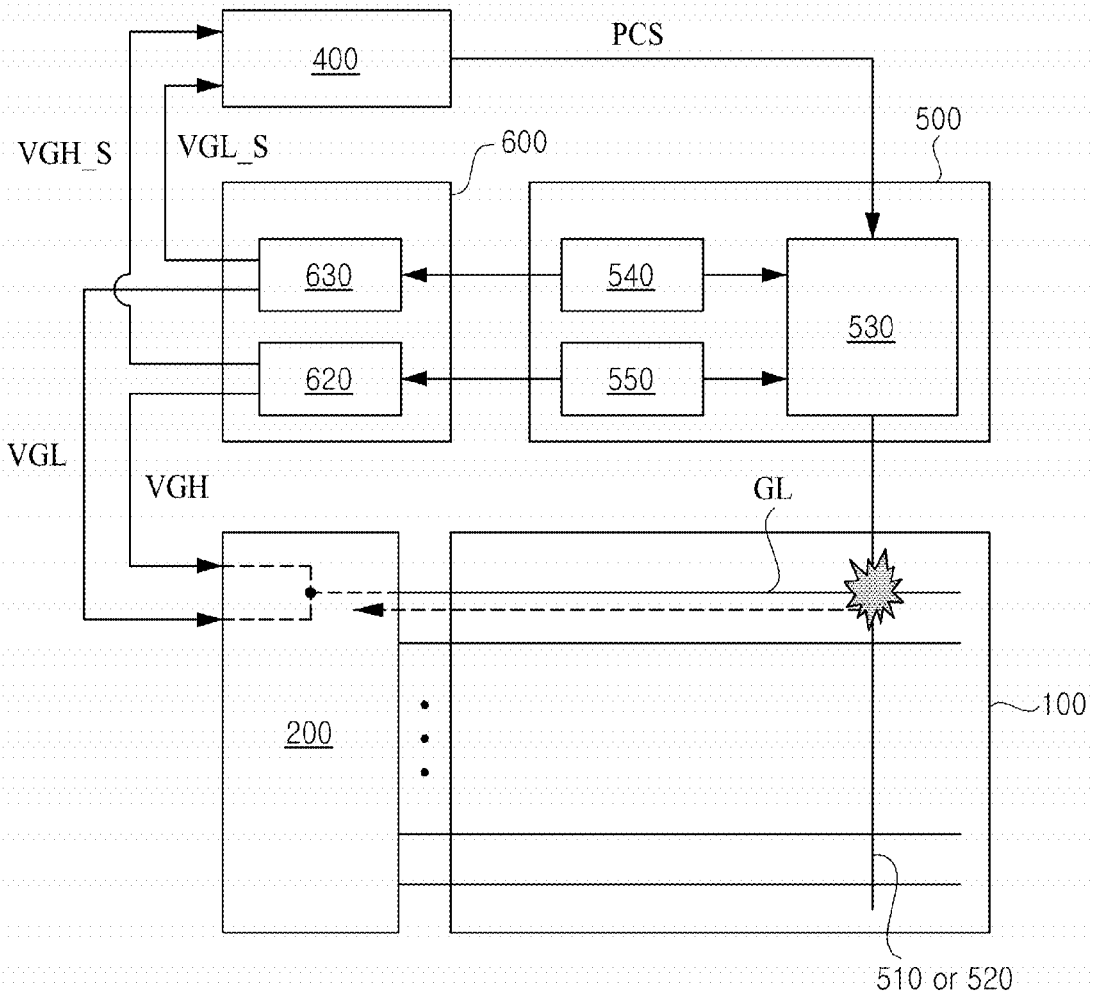
FIG. 5 is an exemplary diagram illustrating a configuration of the detection unit applied to the organic light emitting display device according to the present invention.

FIG. 5 is an exemplary diagram illustrating a configuration of the detection unit applied to the organic light emitting display device according to the present invention.

The organic light emitting display device according to the present invention, as described above, includes the panel 100, the gate driving IC 200, the source driving IC 300, the power supply 500, the detection unit 600, and the timing controller 400. Hereinafter, details identical or similar to the details described above with reference to FIGS. 3 and 4 are not provided, or will be briefly described.

The gate lines GL, the data lines DL, the reference voltage line 510, the input voltage line 520, the high-level driving voltage line, and the low-level driving voltage are formed in the panel 100. In particular, the gate lines GL are formed to intersect the reference voltage line 510, the input voltage line 520, the high-level driving voltage line, and the low-level driving voltage line.

The reference voltage line 510 is connected to a plurality of the pixel circuits, and the reference voltage Vref is supplied to the pixel circuits through the reference voltage line 510.

The input voltage line 520 is connected to the pixel circuits, and the input voltage Vinit is supplied to the pixel circuits through the input voltage line 520.

The reference voltage Vref and the input voltage Vinit are supplied to the pixel circuit for the purpose of driving the pixel circuit, compensating for deterioration of the organic light emitting element, and sensing the deterioration of the organic light emitting element.

The high-level driving voltage and the low-level driving voltage are supplied to each of the pixel circuits so as to drive the organic light emitting element.

The gate driving IC 200 sequentially supplies the gate-on signal to the gate lines GL.

To this end, the gate driving IC 200 is electrically connected to the gate lines GL.

The source driving IC 300 respectively supplies data voltages to the data lines DL when the gate-on signal is being supplied to the gate lines GL.

The power supply 500 supplies power desired by the gate driving IC 200 and the data driving IC 300. For example, the power supply 500 generates the gate high voltage VGH and the gate low voltage VGL which are used to generate the scan signal, and supplies the voltages to the gate driving IC 200 through the detection unit 600.

Moreover, the power supply 500 generates the reference voltage Vref, the input voltage Vinit, the high-level driving voltage, and the low-level driving voltage, and supplies the voltages to each of the pixel circuits through the power lines. Hereinafter, a generic name for the reference voltage Vref, the input voltage Vinit, the high-level driving voltage, and the low-level driving voltage is referred to as power. Therefore, the below-described power may be the reference voltage Vref, the input voltage Vinit, the high-level driving voltage, or the low-level driving voltage. However, hereinafter, for convenience of description, the reference voltage or the input voltage is referred to as the power.

In particular, the power supply 500 applied to the present invention generates the power (i.e., the reference voltage Vref and the input voltage Vinit) by using the gate high voltage VGH and the gate low voltage VGL which are supplied to the gate driving IC 200. Hereinafter, a generic name for the gate high voltage VGH and the gate low voltage VGL is referred to as a gate voltage. Also, hereinafter, for convenience of description, the gate low voltage is referred to as a first gate voltage, and the gate high voltage is referred to as a second gate voltage.

Therefore, the power supply 500 may generate the gate voltage used to generate the scan signal, and supply the gate voltage to the gate driving IC 200 through the detection unit 600.

Moreover, the power supply 500 may generate the power by using the gate voltage, and supply the power to the power lines.

To this end, as illustrated in FIG. 5, the power supply 500 includes a first output unit 540 that outputs the first gate voltage to the detection unit 600, a second output unit 550 that outputs the second gate voltage to the detection unit 600, and a power generator 530 that generates the power by using the first and second gate voltages.

For example, the first output unit 540 may generate the gate low voltage, the second output unit 550 may generate the gate high voltage, and the power generator 530 may generate the reference voltage Vref.

The detection unit 600 may detect the panel abnormality in the active area by using a current that is induced through the sensing line 610 through which the gate voltage is supplied to the gate driving IC 200.

To this end, the detection unit 600 includes a gate voltage transferor, which transfers the gate voltage to the gate driving IC through the sensing line, and a detection signal transferor that, when an overcurrent is transferred through the gate line, the gate driving IC 200, and the sensing line 610, generates a detection signal to transfer the detection signal to the timing controller 400.

As described above, the gate voltage may be the first gate driving voltage, which is used to generate the gate-off signal of the scan signal, or the second gate driving voltage that is used to generate the gate-on signal of the scan signal. Hereinafter, a case in which the sensing line 610 is configured with a first sensing signal transfer line and a second sensing signal transfer line will be described as an example of the present invention.

In this case, the detection unit 600 may transfer the first gate driving voltage to the gate driving IC 200 through the first sensing signal transfer line, transfer the second gate driving voltage to the gate driving IC 200 through the second sensing signal transfer line, and detect the panel abnormality by using a first current induced through the first sensing signal transfer line or a second current induced through the second sensing signal transfer line.

For example, when the panel abnormality such as short circuit occurs between the power lines or between the gate line and the power line, current consumption increases, causing an overcurrent to flow through the gate line.

In this case, the overcurrent is induced to the sensing line 610 through the gate driving IC 200 electrically connected to the gate line, and is finally induced to the detection unit 600.

Therefore, when the overcurrent is induced through the sensing line 610, the detection unit 600 determines that the panel abnormality occurs in the panel 100, and generates the detection signal. The detection signal is transferred to the timing controller 400, which may stop an operation of at least one of the gate driving IC 200, the source driving IC 300, and the power supply 500 according to the detection signal.

The detection unit 600 may determine whether the panel abnormality occurs, by using all or one of the first and second gate driving voltages.

In this case, as illustrated in FIG. 5, the detection unit 600 includes: a first detector 630 that transfers the first gate driving voltage to the gate driving IC 200 through the first sensing signal transfer line, and detects the panel abnormality by using a current transferred through the first sensing signal transfer line; and a second detector 620 that transfers the second gate driving voltage to the gate driving IC 200 through the second sensing signal transfer line, and detects the panel abnormality by using a current transferred through the second sensing signal transfer line.

A detailed configuration and function of the detection unit 600 will be described in detail with reference to FIGS. 6 to 9.

When the detection signal indicating occurrence of the panel abnormality is transferred from the detection unit 600, the timing controller 400 may stop the operation of at least one of the gate driving IC 200, the source driving IC 300, and the power supply 500. In particular, the panel abnormality occurs, and when the power is supplied to the power line, there is a high possibility that the panel 100, the gate driving IC 200, and the source driving IC 300 are damaged. Therefore, when the detection signal is transferred, the timing controller 400 may preferentially stop the operation of the power supply 500.

A method of driving the organic light emitting display device according to the present invention will now be described.

For example, the method of driving the organic light emitting display device according to the present invention includes: an operation that supplies the power to the power lines, which are formed to intersect the gate lines, to drive the pixel circuits included in the panel 100, in the active area 120 of the panel 100 in which the gate lines and the data lines are formed; an operation that detects the panel abnormality in the active area 120 by using a sensing signal collected through the sensing line 610 electrically connected to the gate line; and an operation that, when the panel abnormality is detected, cuts off the power supplied to the power lines.

Here, an operation of driving the pixel circuits includes: an operation that generates the gate voltage, which is used to generate the scan signal supplied to the gate line, to supply the gate voltage to the gate lines; and an operation that generates the power by using the gate voltage to supply the power to the power lines.

Moreover, in the operation of detecting the panel abnormality, the detection unit 600 may detect the panel abnormality in the active area by using a current induced through the sensing line 610 electrically connected to the gate line.

In particular, when an overcurrent is transferred through the sensing line, the detection unit 600 may determine the panel abnormality as being detected.

Figure 6:
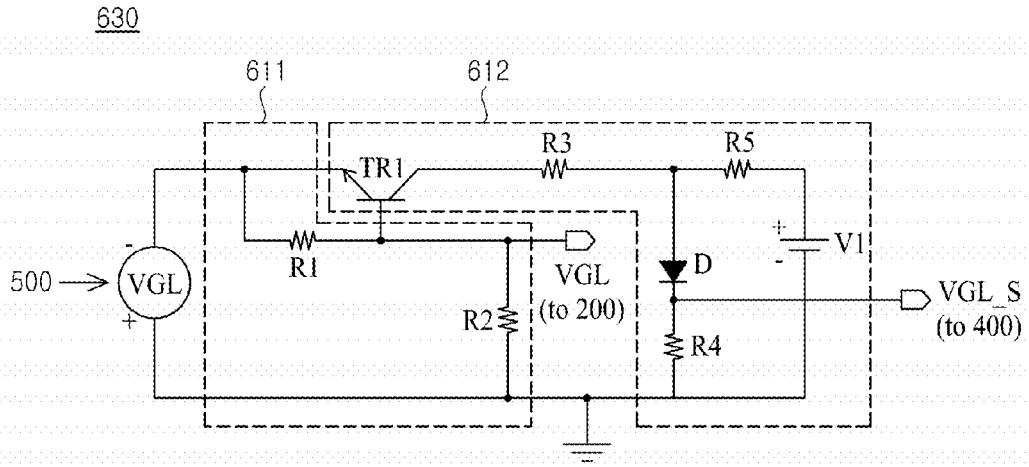
FIG. 6 is exemplary diagrams for describing a configuration and a function of a first detector applied to the organic light emitting display device according to the present invention.
Figure 6:
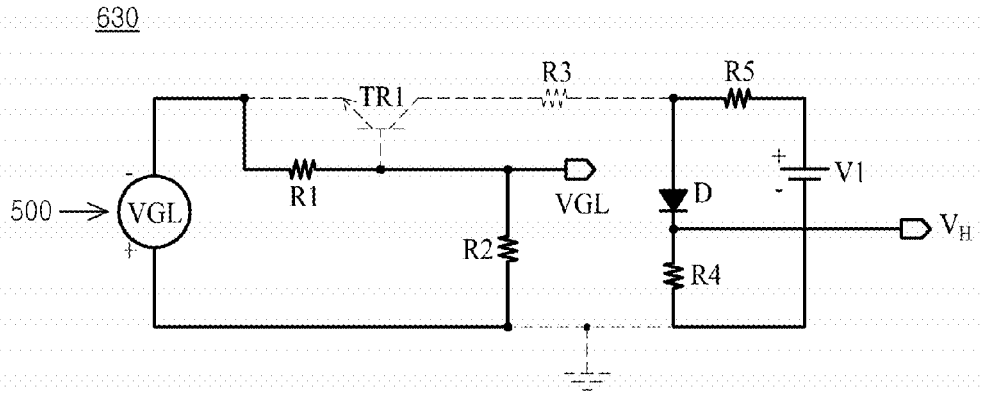
Figure 6:
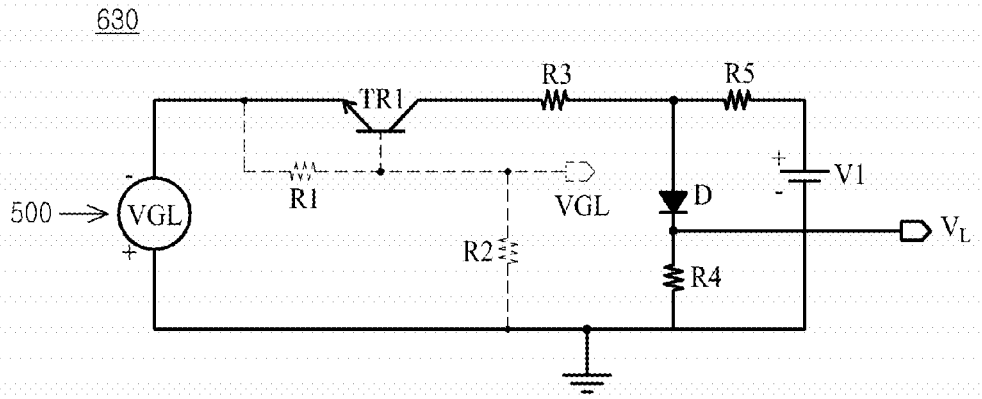
Figure 7:
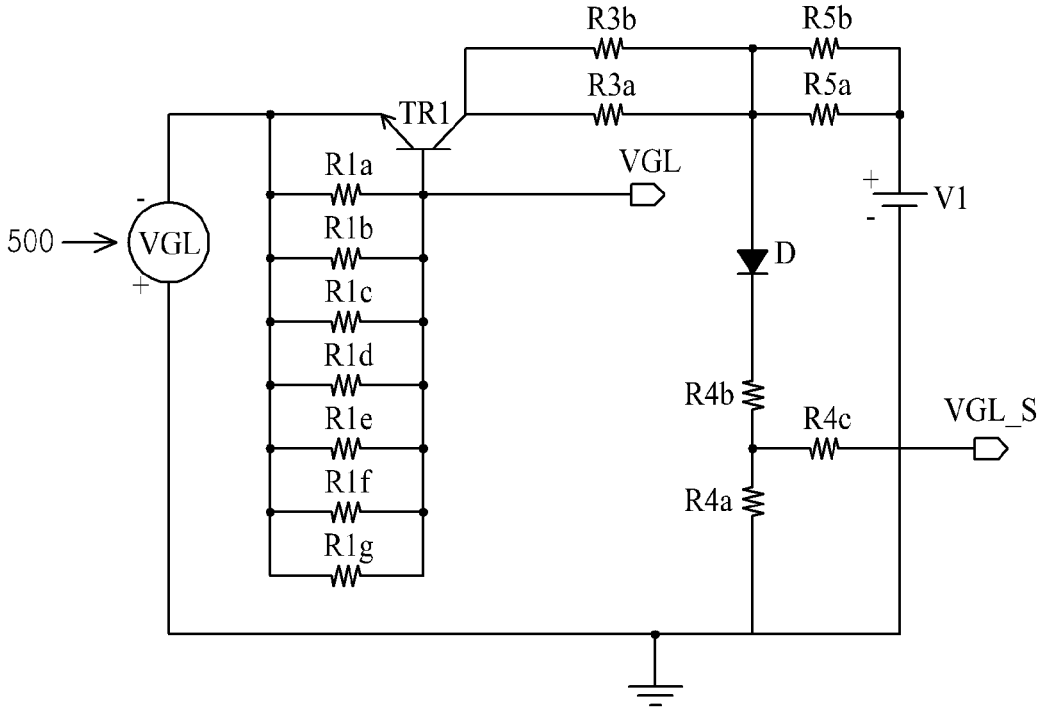
FIG. 7 is an exemplary diagram illustrating a modified configuration of the first detector of FIG. 6.

FIG. 6 is exemplary diagrams for describing a configuration and a function of a first detector applied to the organic light emitting display device according to the present invention, and FIG. 7 is an exemplary diagram illustrating a modified configuration of the first detector of FIG. 6.

The detection unit 600, as illustrated in FIG. 5, may include: the first detector 630 that transfers the first gate driving voltage to the gate driving IC 200 through the first sensing signal transfer line, and detects the panel abnormality by using a current transferred through the first sensing signal transfer line; and the second detector 620 that transfers the second gate driving voltage to the gate driving IC 200 through the second sensing signal transfer line, and detects the panel abnormality by using a current transferred through the second sensing signal transfer line.

The first detector 630, as illustrated in FIG. 6A, includes: a first gate voltage transferor 611 that transfers the first gate driving voltage to the gate driving IC 200 through the first sensing signal transfer line; and a first detection signal transferor 612 that, when an overcurrent is transferred through the gate line, the gate driving IC 200, and the first sensing signal transfer line, generates a first detection signal VGL_S to transfer the first detection signal VGL_S to the timing controller 400. Here, the first gate driving voltage may be the gate low voltage VGL that turns off the switching transistor included in the pixel circuit.

The first gate voltage transferor 611 includes resistors R1 and R2 that are connected to the first gate voltage VGL supplied from the power supply 500, and transfers the first gate voltage VGL to the gate driving IC 200 through the first sensing signal transfer line.

The first detection signal transferor 612 includes: a first transistor TR1 that includes a first terminal connected to the first gate voltage transferor 611 and a second terminal (a gate) connected to the first sensing signal transfer line, and is turned on with an overcurrent induced through the first sensing signal transfer line; and a first detection signal generator that is connected to a third terminal of the first transistor TR1, and when the first transistor TR1 is turned on with the overcurrent, transfers the detection signal indicating occurrence of the panel abnormality to the timing controller 400. The first detection signal generator, as illustrated in FIG. 6A, may include a first detection voltage source V1, a fifth resistor R5, a diode D, and a fourth resistor R4. A third resistor R3 may be connected between the first transistor TR1 and the first detection signal generator.

When the panel abnormality does not occur in the panel 100, a method of operating the first detector 630 will be described in detail with reference to FIG. 6B.

When the panel abnormality does not occur in the panel 100, an overcurrent is not supplied to the detection unit 600 through the gate line, the gate driving IC 200, and the sensing line 610. Therefore, the first transistor TR1 having an N type is turned off.

The first gate voltage transferor 611 and the first detection signal transferor 612 are separately driven according to the first transistor TR1 being turned off.

Therefore, the first gate driving voltage VGL is transferred to the gate driving IC 200 through the first gate voltage transferor 611 and the sensing line 610.

In this case, the first detection signal generator outputs a high-level detection signal $V_H$ with a first detection voltage V1, and the high-level detection signal $V_H$ is transferred to the timing controller 400.

The timing controller 400 receiving the high-level detection signal $V_H$ determines the panel abnormality as not occurring in the panel 100, and normally drives the power supply 500.

When the panel abnormality occurs in the panel 100, a method of operating the first detector 630 will be described in detail with reference to FIG. 6C.

When the panel abnormality occurs in the panel 100, an overcurrent is supplied to the detection unit 600 through the gate line, the gate driving IC 200, and the sensing line 610. Therefore, the first transistor TR1 having the N type is turned on.

The first gate voltage transferor 611 is electrically connected to the first detection signal transferor 612 according to the first transistor TR1 being turned on.

In this case, in the first detection signal generator, a current generated from the first detection voltage source V1 is distributed to the first transistor TR1 and the diode D. Therefore, a low-level detection signal $V_L$ is output through a cathode of the diode D, and the low-level detection signal $V_L$ is transferred to the timing controller 400.

The timing controller 400 receiving the low-level detection signal $V_L$ determines the panel abnormality as occurring in the panel 100, and stops driving of the power supply 500.

As described above, when an overcurrent is not transferred through the gate line, the gate driving IC 200, and the sensing line 610, the first detector 630 supplying the first gate driving voltage VGL to the gate driving IC 200 transfers the high-level detection signal VH to the timing controller 400, and when the overcurrent is transferred through the gate line, the gate driving IC 200, and the sensing line the first detector 630 transfers the low-level detection signal VL to the timing controller 400.

When the high-level detection signal $V_H$ is transferred, the timing controller 400 normally drives the power supply 500, and when the low-level detection signal $V_L$ is transferred, the timing controller 400 stops driving of the power supply 500, thereby preventing the panel 100, the gate driving IC 200, the source driving IC 300, and the power supply 500 from being damaged.

A level of the detection signal VGL_S output by the first detector 630 may be variously set according to a connection method between a plurality of resistors as illustrated in FIG. 7.

For example, the first and second resistors R1 and R2 may be replaced with a plurality of resistors R1*a* to R1*g* that are connected in parallel. The third resistor R3 may be replaced with a plurality of resistors R3*a* and R3*b* that are connected in parallel. The fourth resistor R4 may be replaced with a plurality of resistors R4*a*, R3*b* and R3*c* that are connected in parallel or series. The fifth resistor R5 may be replaced with a plurality of resistors R5*a* and R5*b* that are connected in parallel.

Figure 8:
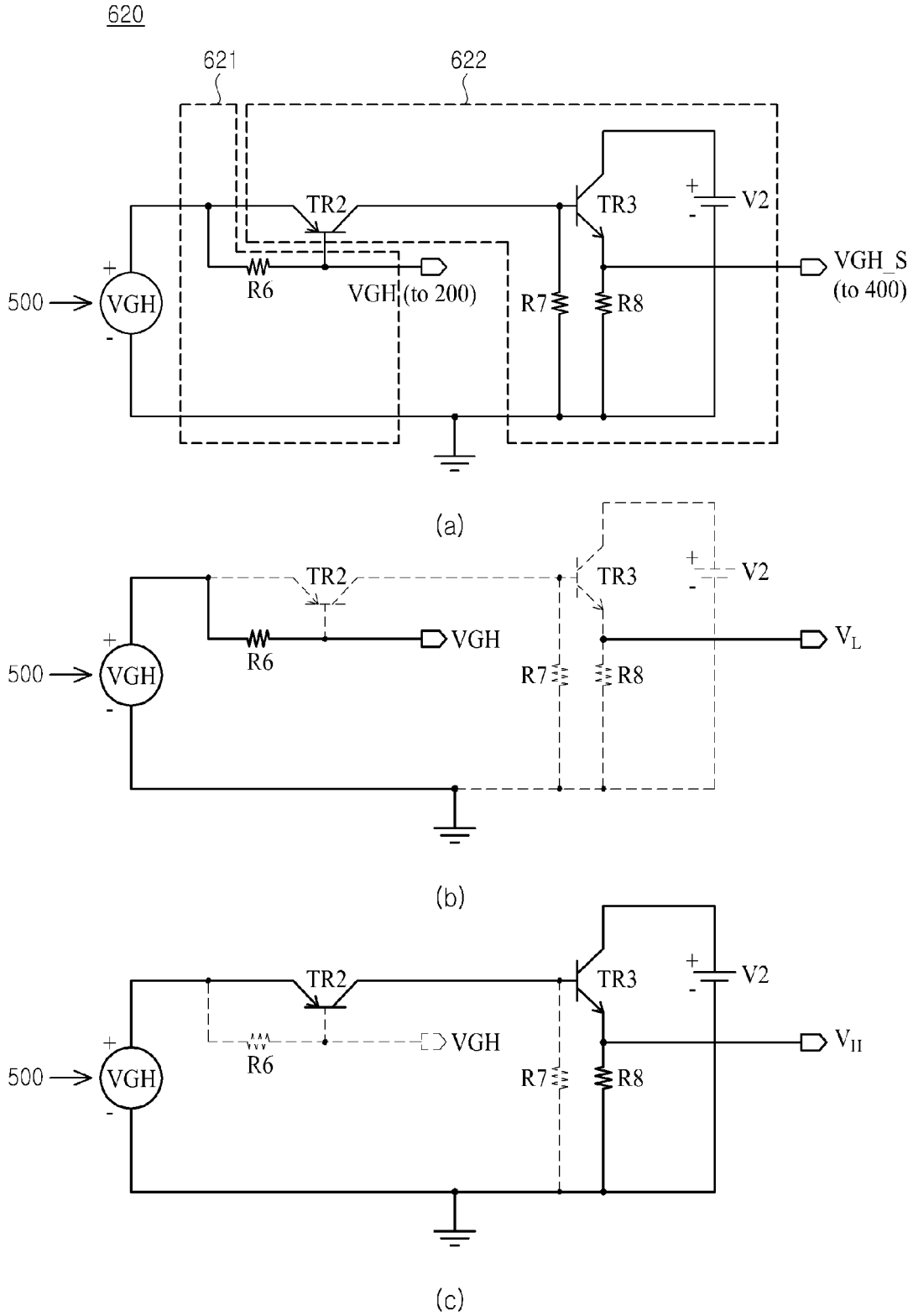
FIG. 8 is exemplary diagrams for describing a configuration and a function of a second detector applied to the organic light emitting display device according to the present invention.
Figure 9:
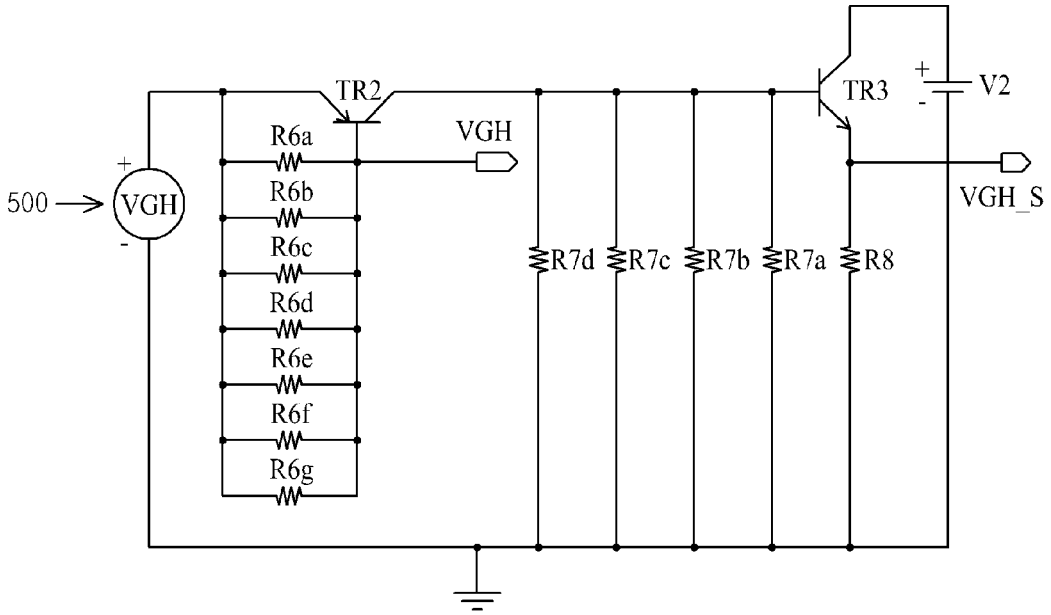
FIG. 9 is an exemplary diagram illustrating a modified configuration of the second detector of FIG. 8.

FIG. 8 is exemplary diagrams for describing a configuration and a function of the second detector applied to the organic light emitting display device according to the present invention, and FIG. 9 is an exemplary diagram illustrating a modified configuration of the second detector of FIG. 8.

The detection unit 600, as illustrated in FIG. 8, may include: the first detector 630 that transfers the first gate driving voltage to the gate driving IC 200 through the first sensing signal transfer line, and detects the panel abnormality by using a current transferred through the first sensing signal transfer line; and the second detector 620 that transfers the second gate driving voltage to the gate driving IC 200 through the second sensing signal transfer line, and detects the panel abnormality by using a current transferred through the second sensing signal transfer line.

The second detector 620, as illustrated in FIG. 8A, includes: a second gate voltage transferor 621 that transfers the second gate driving voltage to the gate driving IC 200 through the second sensing signal transfer line; and a second detection signal transferor 622 that, when an overcurrent is transferred through the gate line, the gate driving IC 200, and the second sensing signal transfer line, generates a second detection signal VGH_S to transfer the second detection signal VGH_S to the timing controller 400. Here, the second gate driving voltage may be the gate high voltage VGH that turns off the switching transistor included in the pixel circuit.

The second gate voltage transferor 621 includes a sixth resistor R6 that is connected to the second gate voltage VGH supplied from the power supply 500, and transfers the second gate voltage VGH to the gate driving IC 200 through the second sensing signal transfer line.

The second detection signal transferor 622 includes: a second transistor TR2 that includes a first terminal connected to the second gate voltage transferor 621 and a second terminal (a gate) connected to the second sensing signal transfer line, and is turned on with an overcurrent induced through the second sensing signal transfer line; and a second detection signal generator that is connected to a third terminal of the second transistor TR2, and when the second transistor TR2 is turned on with the overcurrent, transfers the detection signal indicating occurrence of the panel abnormality to the timing controller 400. The second detection signal generator, as illustrated in FIG. 8A, may include a second detection voltage source V2, a third transistor TR3, and an eighth resistor R8. A seventh resistor R7 may be connected between the second transistor TR2 and the second detection signal generator.

When the panel abnormality does not occur in the panel 100, a method of operating the second detector 620 will be described in detail with reference to FIG. 8B.

When the panel abnormality does not occur in the panel 100, an overcurrent is not supplied to the detection unit 600 through the gate line, the gate driving IC 200, and the sensing line 610. Therefore, the second transistor TR2 having an P type is turned off.

The second gate voltage transferor 621 and the second detection signal transferor 622 are separately driven according to the second transistor TR2 being turned off.

Therefore, the second gate driving voltage VGH is transferred to the gate driving IC 200 through the second gate voltage transferor 621 and the sensing line 610.

In this case, in the second detection signal generator, since a current generated from the second detection voltage source V2 does not pass through the third transistor TR3, a low-level detection signal $V_L$ is output from a node between the third transistor TR3 and the eighth resistor R8, and the low-level detection signal $V_L$ is transferred to the timing controller 400.

The timing controller 400 receiving the low-level detection signal $V_L$ determines the panel abnormality as not occurring in the panel 100, and normally drives the power supply 500.

When the panel abnormality occurs in the panel 100, a method of operating the second detector 620 will be described in detail with reference to FIG. 8C.

When the panel abnormality occurs in the panel 100, an overcurrent is supplied to the detection unit 600 through the gate line, the gate driving IC 200, and the sensing line 610. Therefore, the second transistor TR2 having the P type is turned on.

The third transistor TR3 is also turned on according to the second transistor TR2 being turned on.

In this case, in the second detection signal generator, since a current generated from the second detection voltage source V2 passes through the third transistor TR3, a high-level detection signal $V_H$ is output from the node between the third transistor TR3 and the eighth resistor R8, and the high-level detection signal $V_H$ is transferred to the timing controller 400.

The timing controller 400 receiving the high-level detection signal $V_H$ determines the panel abnormality as not occurring in the panel 100, and stops driving of the power supply 500.

As described above, when an overcurrent is not transferred through the gate line, the gate driving IC 200, and the sensing line 610, the second detector 620 supplying the second gate driving voltage VGH to the gate driving IC 200 transfers the low-level detection signal $V_L$ to the timing controller 400, and when the overcurrent is transferred through the gate line, the gate driving IC 200, and the sensing line 610, the second detector 620 transfers the high-level detection signal $V_H$ to the timing controller 400.

When the low-level detection signal $V_L$ is transferred, the timing controller 400 normally drives the power supply 500, and when the high-level detection signal $V_H$ is transferred, the timing controller 400 stops driving of the power supply 500, thereby preventing the panel 100, the gate driving IC 200, the source driving IC 300, and the power supply 500 from being damaged.

A level of the detection signal VGH_S output by the second detector 620 may be variously set according to a connection method between a plurality of resistors as illustrated in FIG. 9.

For example, the sixth resistor R6 may be replaced with a plurality of resistors R6*a* to R6*g* that are connected in parallel. The seventh resistor R7 may be replaced with a plurality of resistors R7*a* to R7*d* that are connected in parallel.

According to the present invention, a panel abnormality in the active area is detected by using a sensing signal collected through the gate line, and thus, a sensing line is not additionally formed in the active area.

Moreover, the present invention detects a panel abnormality in the active area to control driving of the power supply or source diving IC, thus preventing the panel abnormality in the active area from being spread.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a panel in which a plurality of pixels are respectively formed in a plurality of intersection areas between a plurality of gate lines and a plurality of data lines formed in an active area, a pixel circuit is included in each of the plurality of pixels, and a plurality of power lines are formed for supplying power to drive the pixel circuit;

a gate driving integrated circuit (IC) configured to supply a scan signal to the plurality of gate lines;

a power supply configured to supply the power to the power lines;

a detection unit configured to detect a panel abnormality in the active area by using a sensing signal collected through a sensing line electrically connected to a corresponding gate line; and a controller configured to control driving of the power supply according to the detection result of the detection unit, wherein the sensing line includes at least one of a line transferring a gate high voltage of the scan signal to the gate driving IC and a line transferring a gate low voltage of the scan signal to the gate driving IC, and wherein the power supply generates a gate voltage used to generate the scan signal to supply the gate voltage to the gate driving IC through the detection unit, and generates the power by using the gate voltage to supply the power to the power lines.

2. The organic light emitting display device of claim 1, wherein the power lines comprises at least one of a high-level voltage line for supplying a high-level voltage to an organic light emitting element, a low-level voltage line for supplying a low-level voltage to the organic light emitting element, a reference voltage line for supplying a reference voltage for driving of the organic light emitting element to a corresponding pixel, and an input voltage line for supplying an input voltage for driving of the organic light emitting element to the corresponding pixel.

3. The organic light emitting display device of claim 1, wherein the detection unit detects the panel abnormality by using a gate high voltage or a gate low voltage of the scan signal or a current generated from the gate high voltage or the gate low voltage.

4. The organic light emitting display device of claim 1, wherein, the detection unit generates a detection signal by using a sensing signal transferred through a corresponding gate line and the gate driving IC, and transfers the detection signal to the controller, and when the detection signal indicating occurrence of the panel abnormality is transferred, the controller stops driving of the power supply.

5. The organic light emitting display device of claim 1, wherein the detection unit is electrically connected to at least one or more of the plurality of gate lines, formed in the panel, through the gate driving IC.

6. The organic light emitting display device of claim 1, wherein when a detection signal indicating occurrence of the panel abnormality is transferred from the detection unit, the controller stops driving of the gate driving IC, driving of the source driving IC respectively supplying data voltages to the plurality of data lines, or driving of the power supply.

7. The organic light emitting display device of claim 1, wherein the detection unit detects the panel abnormality by using a current induced through the sensing line through which the gate voltage is supplied to the gate driving IC.

8. The organic light emitting display device of claim 1, wherein the detection unit comprises:

a gate voltage transferor configured to transfer the gate voltage to the gate driving IC through the sensing line; and a detection signal transferor configured to, when an overcurrent is transferred through the corresponding gate line, the gate driving IC, and the sensing line, generate a detection signal indicating occurrence of the panel abnormality to transfer the detection signal to the controller.

9. The organic light emitting display device of claim 8, wherein the gate voltage is one of a first gate driving voltage, which is used to generate a gate-off signal of the scan signal, or a second gate driving voltage that is used to generate a gate-on signal of the scan signal.

10. The organic light emitting display device of claim 1, wherein, the gate voltage comprises a first gate driving voltage, which is used to generate a gate-off signal of the scan signal, and a second gate driving voltage that is used to generate a gate-on signal of the scan signal, and the sensing line comprises a first sensing signal transfer line and a second sensing signal transfer line.

11. The organic light emitting display device of claim 10, wherein, the detection unit transfers the first gate driving voltage to the gate driving IC through the first sensing signal transfer line, the detection unit transfers the second gate driving voltage to the gate driving IC through the second sensing signal transfer line, and the detection unit detects the panel abnormality by using a first current induced through the first sensing signal transfer line or a second current induced through the second sensing signal transfer line.

12. The organic light emitting display device of claim 10, wherein the detection unit comprises:

a first detector configured to transfer the first gate driving voltage to the gate driving IC through the first sensing signal transfer line, and detect the panel abnormality by using a current transferred through the first sensing signal transfer line; and a second detector configured to transfer the second gate driving voltage to the gate driving IC through the second sensing signal transfer line, and detect the panel abnormality by using a current transferred through the second sensing signal transfer line.

13. The organic light emitting display device of claim 12, wherein the first detector comprises:

a first gate voltage transferor configured to transfer the first gate driving voltage to the gate driving IC through the first sensing signal transfer line; and a first detection signal transferor configured to, when an overcurrent is transferred through a corresponding gate line, the gate driving IC, and the first sensing signal transfer line, generate a first detection signal indicating occurrence of the panel abnormality to transfer the first detection signal to the controller.

14. The organic light emitting display device of claim 13, wherein the second detector comprises:

a second gate voltage transferor configured to transfer the second gate driving voltage to the gate driving IC through the second sensing signal transfer line; and a second detection signal transferor configured to, when the overcurrent is transferred through a corresponding gate line, the gate driving IC, and the second sensing signal transfer line, generate a second detection signal indicating occurrence of the panel abnormality to transfer the second detection signal to the controller.

15. A method of driving an organic light emitting display device, the method comprising:

supplying power to a plurality of power lines, which are formed in an active area of a panel in which a plurality of gate lines and a plurality of data lines are formed, to drive a plurality of pixel circuits comprised in the panel;

detecting a panel abnormality in the active area by using a sensing signal collected through a sensing line including at least one of a line transferring a gate high voltage of a scan signal, sequentially supplied to the gate lines, to a gate driving integrated circuit (IC) and a line transferring a gate low voltage of the scan signal to the gate driving IC; and when the panel abnormality is detected, cutting off the power supplied to the plurality of power lines, and the driving of a plurality of pixel circuits comprises;

generating a gate voltage, used to generate the scan signal, to supply the gate voltage to the plurality of gate lines; and generating the power by using the gate voltage to supply the power to the plurality of power lines.

16. The method of claim 15, wherein the detecting of a panel abnormality comprises detecting the panel abnormality by using a current induced through the sensing line electrically connected to the corresponding gate line.

17. The method of claim 15, wherein the cutting off of the power comprises, when the detection signal indicating occurrence of the panel abnormality is transferred, stopping driving of the power supply that generates the power.

* * * * *